US009433548B2

(12) United States Patent
Dovervik et al.

(10) Patent No.: US 9,433,548 B2
(45) Date of Patent: Sep. 6, 2016

(54) PERSON SUPPORT DEVICE

(75) Inventors: Elin Dovervik, Lulea (SE); Catherine Ringbjer, Lulea (SE); Hanna Youngstrom, Kullavik (SE); Anders Eriksson, Lulea (SE); Mattias Andersson, Soedra Sunderbyn (SE)

(73) Assignee: Liko Research & Development AB, Lulea (SE)

( * ) Notice: Subject to any disclaimer, the term of this patent is extended or adjusted under 35 U.S.C. 154(b) by 362 days.

(21) Appl. No.: 13/327,899

(22) Filed: Dec. 16, 2011

(65) Prior Publication Data

US 2013/0152304 A1 Jun. 20, 2013

(51) Int. Cl.
*A61G 7/10* (2006.01)

(52) U.S. Cl.
CPC ..... *A61G 7/1051* (2013.01)

(58) Field of Classification Search
CPC ..... A61G 7/1023; A61G 7/1051; A61G 7/1059; A61G 1/01; A61G 1/044; A61G 1/048; A61F 5/37; A61F 5/3738; A61F 5/3746; A01K 1/0263; A01K 27/002
USPC ..... 5/81.1 T, 89.1
See application file for complete search history.

(56) References Cited

U.S. PATENT DOCUMENTS 5,396,670 A * 3/1995 Firebaugh et al. ..... 5/89.1
5,530,975 A 7/1996 Firebaugh et al.
6,175,973 B1 * 1/2001 Hakamiun et al. ..... 5/89.1
6,289,534 B1 9/2001 Hakamiun et al.
6,671,899 B1 * 1/2004 Oja ..... 5/89.1
7,624,458 B2 12/2009 Felling

FOREIGN PATENT DOCUMENTS

EP 0748619 B1 5/2001
FR 2941369 A1 7/2010
GB 2320486 A 6/1998
GB 2338222 A 12/1999

OTHER PUBLICATIONS

Liko Support Vest Instruction Guide; Document No. 7EN60118; Liko AB, Nedre vagen 100, SE-975-92, Lulea, Sweden; Copyright Liko AB May 2001.
Liko MasterVest, Mod 60, 64 Instruction Guide; Document No. 7EN160107-01; Liko AB, Nedre vagen 100, SE-975-92, Lulea, Sweden; Copyright Liko AB Oct. 2002.
Liko Hygiene Sling, Mod. 40, 45, 46 Instruction Guide; Document No. 7EN160166-01; Liko AB, Nedre vagen 100, SE-975-92, Lulea, Sweden; Copyright Liko AB May 2007.
Liko Lifting Accessories; Document No. 7EN160305-01; Liko AB, Nedre vagen 100, SE-975-92, Lulea, Sweden; Copyright Liko AB Dec. 2003.

(Continued)

*Primary Examiner* — Nicholas Polito
(74) *Attorney, Agent, or Firm* — Jason Penninger

(57) ABSTRACT

A person support device comprises a body support, a first support loop, and a second support loop. The body support is configured to support at least a portion of a person. The first support loop is coupled to the body support and extends there from a first distance. The second support loop is coupled to the body support and is overlappingly coupled along a portion of the first support loop. The second support loop extends a second distance from the body support.

18 Claims, 8 Drawing Sheets

(56) References Cited

OTHER PUBLICATIONS

Liko Lifting Children; Document No. 7EN16031501; Liko AB, Nedre vagen 100, SS-975-92, Lulea, Sweden; Copyright Liko AB Sep. 2006.

Liko Lifts With Care; Document No. 7EN180301-01; Liko AB, Nedre vagen 100, SE-975-92, Lulea, Sweden.

Liko Byxsele, mod. 40, 45, 46; Bruksanvisning; Document No. 7SV160166-01' Liko AB, Nedre vagen 100, SE-975-92, Lulea, Sweden; Copyright Liko AB Sep. 2005 (No Translation Available.

Liko System Vardlyft; Lyfttillbehor Bruksanvisning 7; Lyftsele for amputerade; Liko, Alvik, Nedre vagen, SE-975-92, Lulea, Sweden; Copyright Liko AB Sep. 1993 (No Translation available).

Patent No. 27416; Feb. 18, 1981; Gunnar Liljedahl; (No Translation available).

Powerpoint of various products available no later than Sep. 28, 2011.

EP Search Report for EP Application 12196805.1; Mailed Mar. 19, 2013; Place of Search—The Hague; Date of completion of the search—Mar. 8, 2013.

European Search Report for EP Application No. 12196805.1 Response; Mailed Dec. 19, 2013.

European Search Report for EP Application No. 12196805.1 Response; Mailed Dec. 19, 2013—Amended Pages.

* cited by examiner

PERSON SUPPORT DEVICE

BACKGROUND OF THE DISCLOSURE

This disclosure relates to person support devices. More particularly, but not exclusively, this disclosure relates to person support devices configured to cooperate with person moving devices to suspend and/or move at least a portion of a person from a first position to a second position. While various person support devices have been developed, there is still room for improvement. Thus a need persists for further contributions in this area of technology.

SUMMARY OF THE DISCLOSURE

In one illustrative embodiment, a person support device comprises a body support, a first support loop, and a second support loop. The body support is configured to support at least a portion of a person. The first support loop is coupled to the body support and extends there from a first distance. The second support loop is coupled to the body support and is overlappingly coupled along a portion of the first support loop. The second support loop extends a second distance from the body support.

In another illustrative embodiment, a person support device comprises a body support, a first support loop, and a second support loop. The first support loop is coupled to the body support. The first support loop includes an upper layer and a lower layer. The second support loop is coupled to the first support loop such that a portion of the second support loop is positioned between the upper layer and the lower layer of the first support loop and extends along a portion of the first support loop.

In another illustrative embodiment, a support extension comprises a first loop of a first length and a second loop of a second length. The second loop is overlappingly coupled to the first loop along a substantial portion of the second length.

Additional features alone or in combination with any other feature(s), including those listed above and those listed in the claims and those described in detail below, can comprise patentable subject matter. Others will become apparent to those skilled in the art upon consideration of the following detailed description of illustrative embodiments exemplifying the best mode of carrying out the invention as presently perceived.

BRIEF DESCRIPTION OF THE DRAWINGS

Referring now to the illustrative examples in the drawings, wherein like numerals represent the same or similar elements throughout.

DETAILED DESCRIPTION OF THE DRAWINGS

Figure 1:
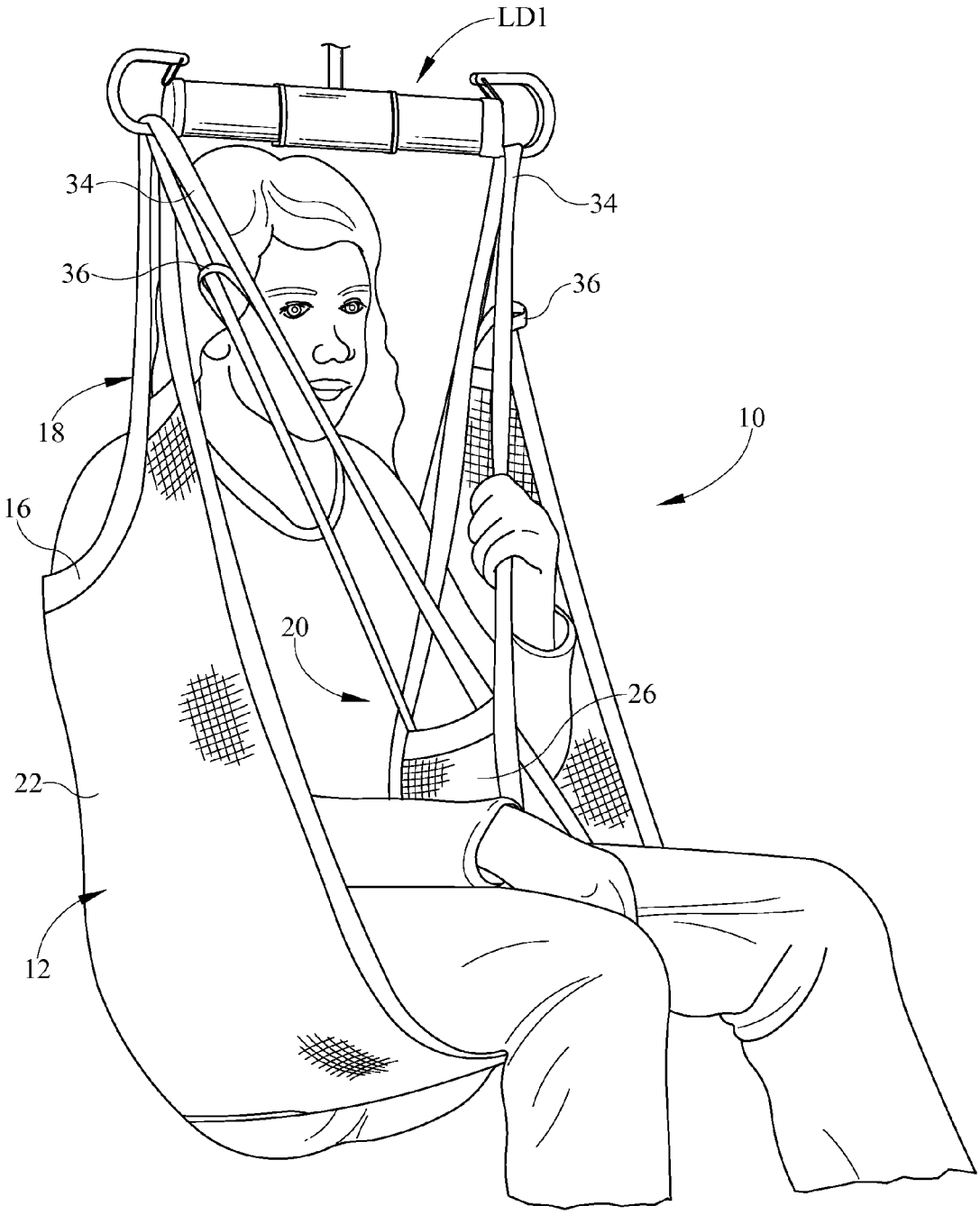
FIG. 1 is a side perspective view of a person support device shown as a person support sling coupled to a lift system and supporting a person according to one illustrative embodiment.

While the present disclosure can take many different forms, for the purpose of promoting an understanding of the principles of the disclosure, reference will now be made to the embodiments illustrated in the drawings, and specific language will be used to describe the same. No limitation of the scope of the disclosure is thereby intended. Various alterations, further modifications of the described embodiments, and any further applications of the principles of the disclosure, as described herein, are contemplated.

A person support device 10 according to one illustrative embodiment of the current disclosure is shown in FIGS. 1-8. The person support device 10 is shown as a person support sling 10 or harness 10 that is configured to be coupled to a sling coupling portion of a person lifting device LD1, such as, a ceiling lift, mobile hoist, or other lifting device, and cooperate therewith to suspend and/or move at least a portion of a person between a first position to a second position by lifting, lowering, turning, and/or transporting. In some contemplated embodiments, the support device 10 can be a disposable lifting harness like the one disclosed in PCT Publication WO 2004/000190. In other contemplated embodiments, the support device 10 can be one or more of the slings, lift sheets, lift straps, wraps, head supports, vests, or other such person support devices sold by Liko®, including, but not limited to, AmputeeSling, ComfortSling Plus, ComfortSling Plus High, ComfortVest, HygieneSling, HygieneVest, LiftPants, MasterVest, MultiStrap, Original HighBack Sling, Soft Original HighBack Sling, OriginalSling, RepoSheet Original, SafetyVest, SilhouetteSling, Solo HighBack, Solo RepoSheet, Solo SupportVest, SupportVest, Ultra Sling, UniversalSling, Octo LiftSheet, and/or Vest for StandingShell.

Figure 2:
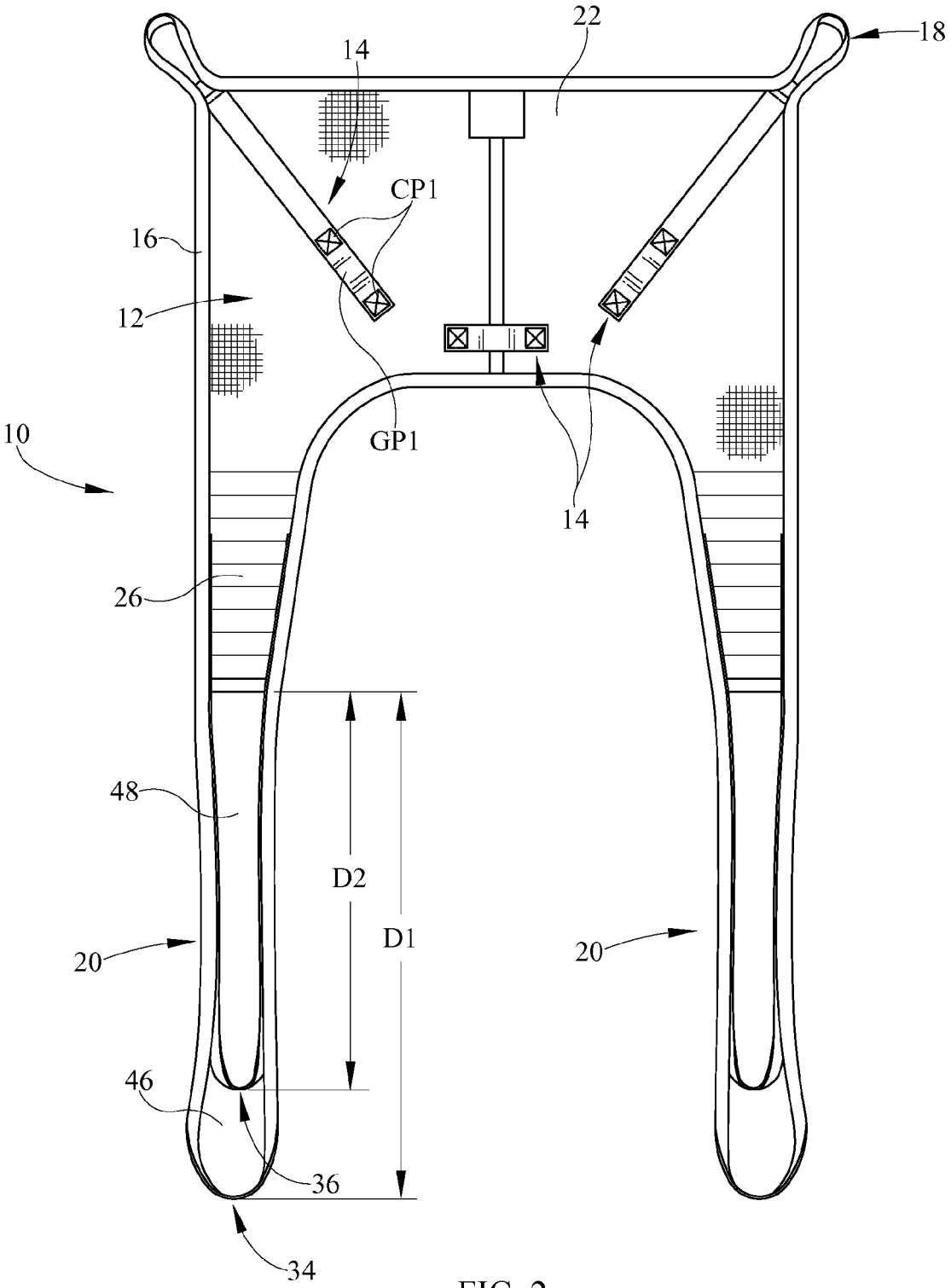
FIG. 2 is a bottom view of the person support device of FIG. 1 showing the main panel, top loops, leg support loops, and handles.

The support device 10 includes a main panel 12 or body support 12, handles 14, a binding 16, upper loops 18, and leg support loops 20. The main panel 12 includes a back support portion 22 and leg support portions 26 extending from the back support portion 22 as shown in FIG. 2. The back support portion 22 is configured to support the occupant's back, including a back portion of the buttocks, and the leg support portions 26 are configured to engage and support the occupant's thighs. In some contemplated embodiments, the main panel 12 is composed of a durable polyester fabric, mesh fabric, or wipe-able material and includes at least one layer of the material. Also, in some contemplated embodiments, a portion of the main panel 12 can be positionable under the buttocks to support the buttocks. In other contemplated embodiments, the leg support portions 26 are padded.

The handles 14 are configured to help a person, such as, a caregiver, move the occupant when the occupant is supported by the person support device 10. The handles 14 include a grip portion GP1 and coupling portions CP1 that couple the handles 14 to the bottom surface of the back support portion 22 as shown in FIG. 2.

Figure 4:
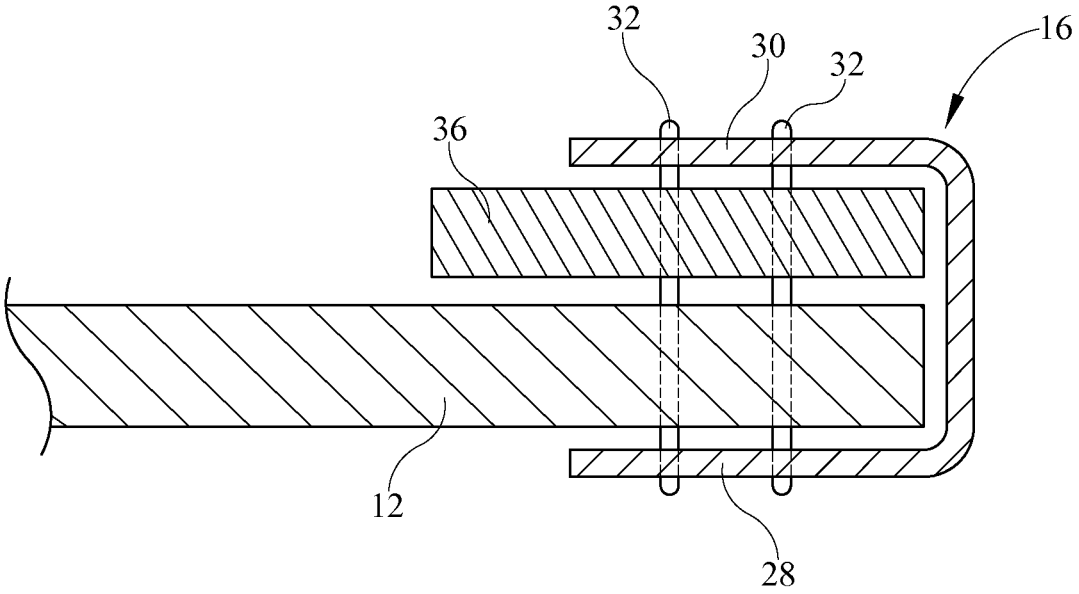
FIG. 4 is a cross-sectional view of the leg support loop of FIG. 2 showing the inner loop and the main panel coupled within the C-shaped binding.
Figure 5:
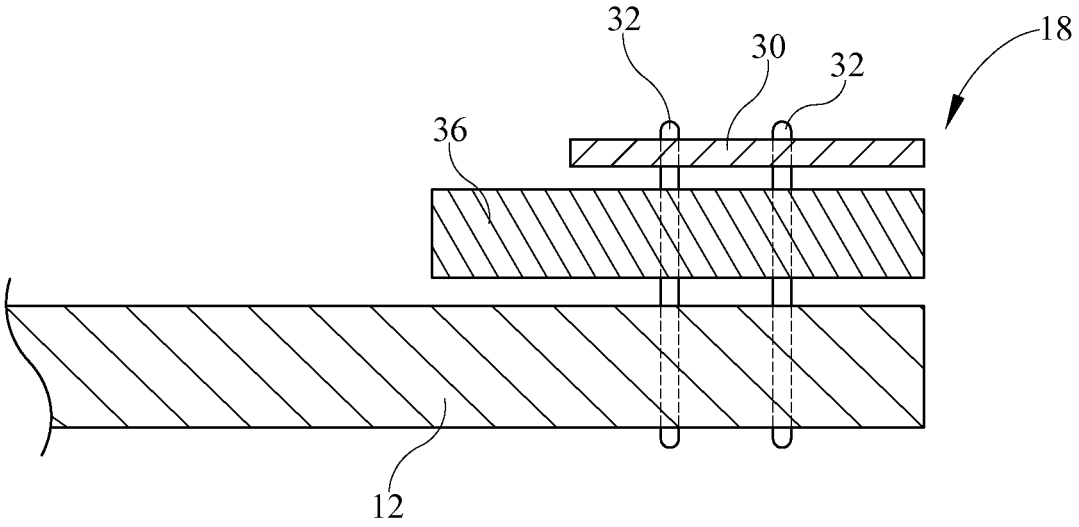
FIG. 5 is a cross-sectional view of the leg support loop of FIG. 2 according to another illustrative embodiment with the inner loop coupled between a single layer binding and the main panel.

The binding 16 is coupled to the perimeter edge of the main panel 12 and forms the upper loops 18 and a portion of the leg support loops 20. In some contemplated embodiments, the binding 16 is not coupled along the perimeter edge of the main panel 12. The binding 16 is C-shaped and includes an upper portion 28 and a lower portion 30 as shown in FIG. 4. In some contemplated embodiments, the binding 16 is a single layer of substantially planar material as shown in FIG. 5. In other contemplated embodiments, the binding 16 is composed of a woven fabric webbing. The perimeter edge of the main panel 12 is positioned between the upper portion 28 and the lower portion 30 and is coupled there between by stitches 32, such as, parallel lockstitch. In some contemplated embodiments, the stitches 32 can be other types of stitching or seams. In other contemplated embodiments, the perimeter edge of the main panel 12 can be coupled between the first portion 28 and the second portion 30 using other techniques, including, but not limited to, ultrasonic welding, heat welding, gluing, and use of fasteners.

The upper loops 18 and the leg support loops 20 are configured to be coupled to the support device coupling portion of the person lifting device LD1 and cooperate therewith to suspend/lift/lower/turn/transport a person supported by the main panel 12. In one illustrative embodiment, the upper loops 18 extend from the back support portion 22 and the leg support loops 20 extend from the leg support portions 26. The upper loops 18 and/or leg support loops 20 can be configured a number of ways to help support people of different sizes and perform different functions. In one illustrative embodiment, the leg support loops 20 include an outer loop 34 and an inner loop 36. In some contemplated embodiments, the upper loops 18 can also include inner and outer loops (not shown). The outer loop 34 is defined by a portion of the binding 16 and extends a first distance D1 from the end of the leg support 26. In some contemplated embodiments, the binding 16 can cross itself to define the outer loop 34 and can be coupled to itself where the portions of the binding 16 intersect. The inner loop 36 is coupled to the outer loop 34 and the leg support 26 and extends a second distance D2 from the end of the leg support 26, which is less than the first distance D1. In some contemplated embodiments, the second distance D2 can be greater than the first distance D1 to allow the inner loop 36 to be used as an extended position rather than a shortened position. The second distance D2 can depend on the size and geometry of the person support device 10. In one illustrative embodiment, the first distance D1 is about 58 cm and the second distance is about 48 cm.

Figure 3:
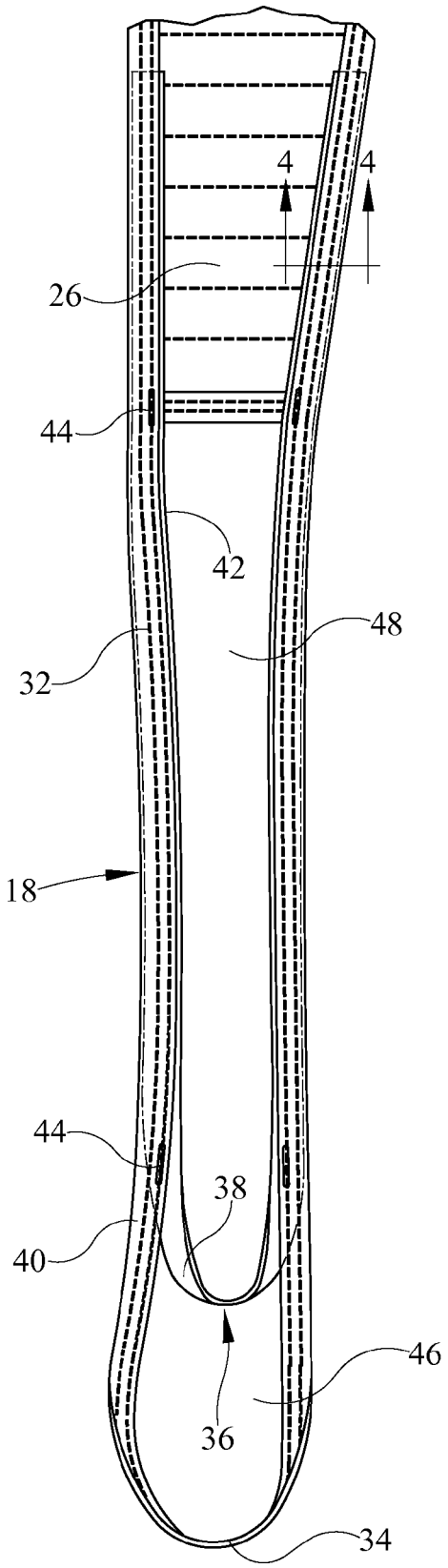
FIG. 3 is a bottom view of the leg support loop of FIG. 2 showing the outer loop and the inner loop.

The inner loop 36 includes a first portion 38 coupled between the sides 40 of the outer loop 34 and a second portion 42 that extends along the sides 40 of the outer loop 34 as shown in FIG. 3. In some contemplated embodiments, the inner loop 36 is composed of woven fabric webbing. In one illustrative embodiment, the first portion 38 is coupled to the sides 40 of the outer loop 34 by bartack stitches 44 and the second portion 42 is positioned between the upper portion 28 and the lower portion 30 of the binding 16 and coupled thereto and to the leg support 26 by stitches 32 as shown in FIGS. 3 & 4. In some contemplated embodiments, the second portion 42 can be coupled on top of or below the outer loop 34. In some contemplated embodiments, the binding 16 can be a single layer of material and a portion of the inner loop 36 is coupled to the binding 16 and coupled between the binding 16 and the main panel 12 as shown in FIG. 5. In other contemplated embodiments, a portion of the inner loop 36 is coupled to the binding 16 and coupled on top of the binding 16 to the main panel 12 so that the binding 16 is positioned between the inner loop 36 and the main panel 12. Coupling the first portion 38 to the sides 40 and the second portion between the upper portion 28 and the lower portion 30 can provide some redundancy and visibility as to the condition of the person support device 10. In some contemplated embodiments, the underside of the upper portion 28 and lower portion 30 (facing the inner loop 36) can be a different color than the outward facing surface of the upper portion 28 and lower portion 30, such as, orange or red, to help alert a person as to the condition of the person support device 10. In other contemplated embodiments, the inner loop 36 is coupled to the main panel 12 so that the inner loop 36 is on the bottom of the person support device 10 and the main panel 12 is closer to the occupant, which helps prevent the end of the edge of the inner loop 36 from contacting the occupant.

The person support device 10 is in a full length configuration when the outer loop 34 is coupled to the lifting device LD1, and in a shortened length configuration when the inner loop 36 is coupled to the lifting device LD1. The inner loop 36 cooperates with the outer loop 34 to define a first opening 46, and cooperates with the outer loop 34 and the leg support portions 26 to define a second opening 48 as shown in FIG. 3. In use, when an occupant is positioned on the device 10 such that their back and thighs are supported by the back support portion 22 and leg support portion 26, respectively, the outer loop 34 of one leg support loop 20 is passed through the second opening 48 of the other leg support loop 20 to crisscross the leg support straps 20 and help maintain the occupant on the person support device 10 as shown in FIG. 1.

Figure 6A:
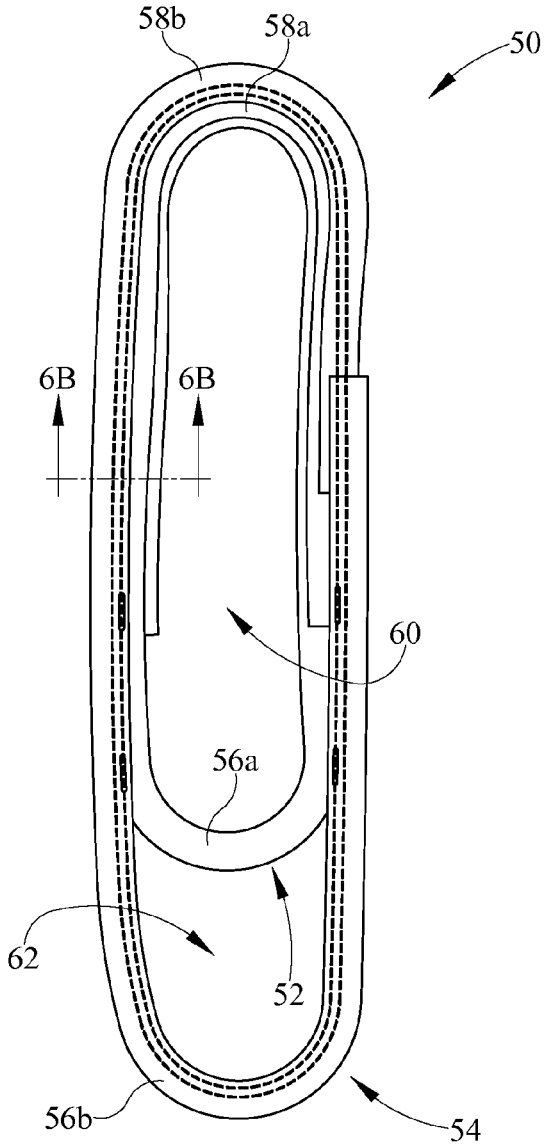
FIG. 6*a* is a top view of an extension loop according to one illustrative embodiment.
Figure 6B:
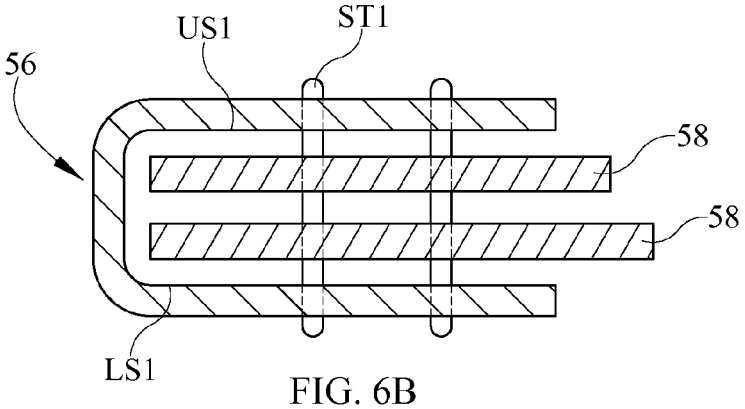
FIG. 6*b* is a cross-sectional view of the extension loop of FIG. 6*a* showing a portion of the inner loop positioned between the upper surface and lower surface of the outer loop.
Figure 7A:
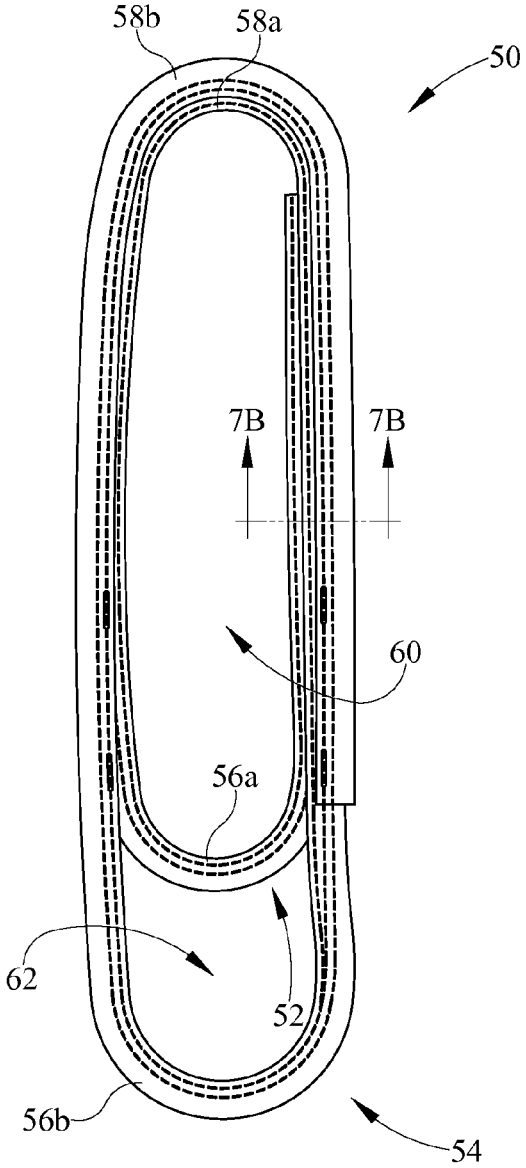
FIG. 7*a* is a top view of an extension loop according to another illustrative embodiment.
Figure 7B:
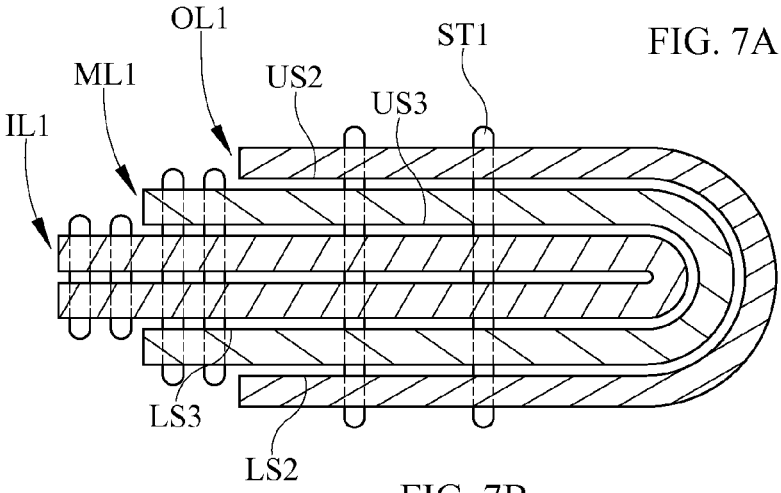
FIG. 7*b* is a cross-sectional view of the extension loop of FIG. 7*a* showing a portion of the inner layer positioned between the upper and lower surfaces of the middle layer, and a portion of the middle layer being positioned between the upper and lower surfaces of the outer layer.
Figure 8:
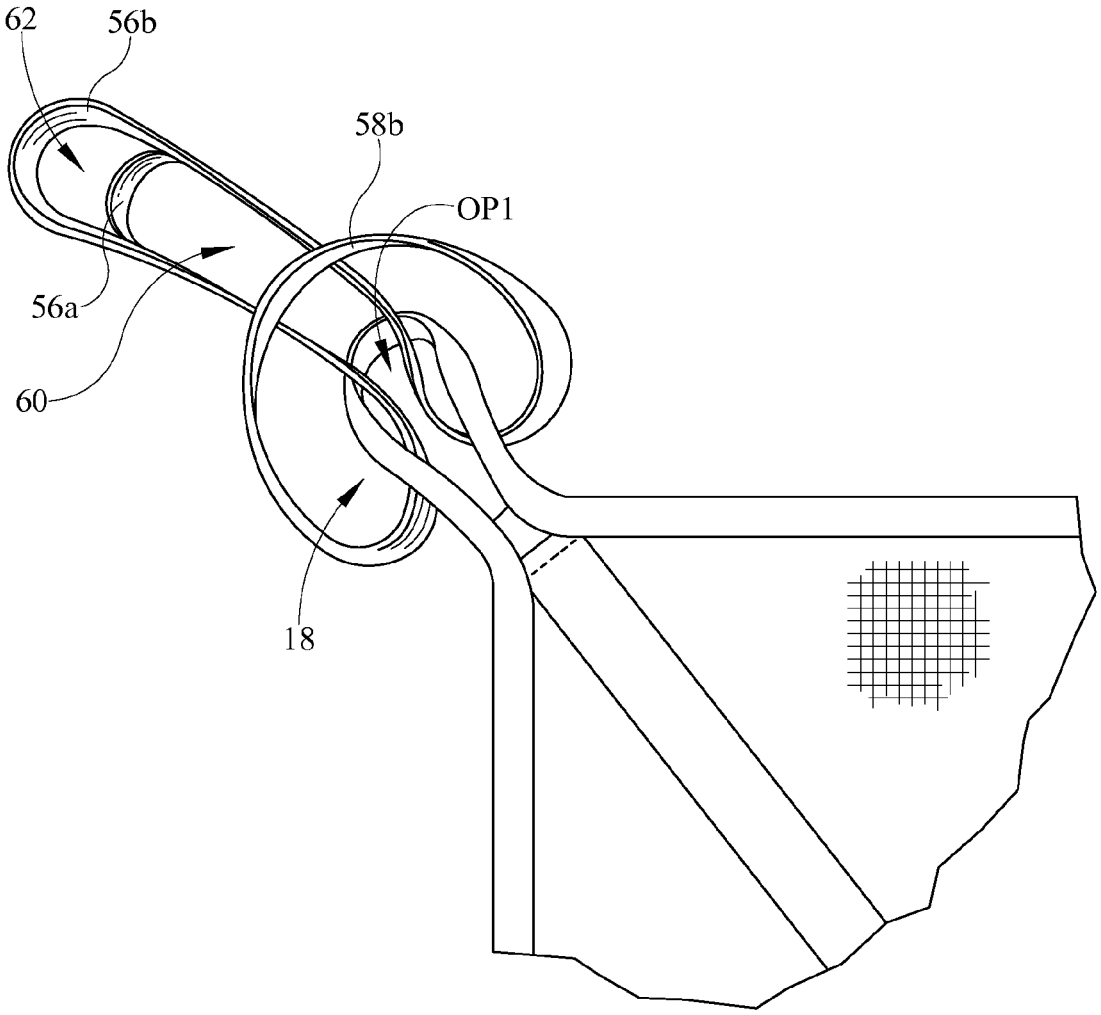
FIG. 8 is a perspective side view of the extension loop being coupled to an upper loop of the person support device of FIG. 1.

In another illustrative embodiment, the upper loop 18 and the leg support loops 20 are coupled to the lifting device coupling portion LD1 via extension loops 50 as shown in FIGS. 6-8. The extension loops 50 comprise two oval shaped loops (an inner loop 52 and an outer loop 54) that overlap one another. In one illustrative embodiment, a first piece of material is overlappingly coupled to itself to form the inner loop 52 and a second piece of material is overlappingly coupled to itself to form the outer loop 54 as shown in FIGS. 6A & B. In this embodiment, a portion of the inner loop 52 is positioned between an upper surface US1 and the lower surface LS1 of the outer loop 54 and coupled together by stitches ST1, such as, parallel lockstitch. In another illustrative embodiment, the inner loop 52 and the outer loop 54 are formed from a single piece of C-shaped material that is coupled to itself by stitches ST1 to form the inner loop 52 and outer loop 54 as shown in FIGS. 7A & B. In this embodiment, the extension loop 50 includes an outer layer OL1, a middle layer ML1, and an inner layer IL1. A portion of the middle layer ML1 is positioned between an upper surface US2 and a lower surface LS2 of the outer layer OL1 and a portion of the inner layer IL1 is positioned between the upper surface US3 and lower surface LS3 of the middle layer ML1 as shown in FIG. 7B.

The loops 52 & 54 include a lifting device coupling portion 56*a* and 56*b*, a support device coupling portion 58*a* and 58*b*, respectively, a first opening 60 between the support device coupling portion 58*a* and 58*b* and the lifting device coupling portion 56*a*, and a second opening 62 between the lifting device coupling portion 56*a* and the lifting device coupling portion 56*b* as shown in FIGS. 6*a*, 7*a*, and 8. The extension loops 50 are coupled to the upper loops 18 and/or leg support loops 20 by passing one end of an extension loop 50 through, for example, the opening OP1 in the upper loop 18 such that the lifting device coupling portion 52 and the support device coupling portion 54 are on opposite sides of the loop 18. The lifting device coupling portions 56*a* and 56*b* are then passed through the first opening 60 so that the support device coupling portion 58*a* and 58*b* wraps around the loop 18 as shown in FIG. 8.

Many other embodiments of the present disclosure are also envisioned. For example, a person support device comprises a body support, a first support loop, and a second support loop. The body support is configured to support at least a portion of a person. The first support loop is coupled to the body support and extends there from a first distance. The second support loop is coupled to the body support and is overlappingly coupled along a portion of the first support loop. The second support loop extends a second distance from the body support.

In another example, a person support device comprises a body support, a first support loop, and a second support loop. The first support loop is coupled to the body support. The first support loop includes an upper layer and a lower layer. The second support loop is coupled to the first support loop such that a portion of the second support loop is positioned between the upper layer and the lower layer of the first support loop and extends along a portion of the first support loop.

In another example, a support extension comprises a first loop of a first length and a second loop of a second length. The second loop is overlappingly coupled to the first loop along a substantial portion of the second length.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described can be more desirable, it nonetheless can not be necessary and embodiments lacking the same can be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used the item can include a portion and/or the entire item unless specifically stated to the contrary.

It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations can be apparent to those skilled in the art. Also, while multiple inventive aspects and principles can have been presented, they need not be utilized in combination, and various combinations of inventive aspects and principles are possible in light of the various embodiments provided above.

What is claimed is:

1. A person support device comprising:

a body support configured to support a person;

a binding coupled along a perimeter edge of the body support and extending from the perimeter edge of the body support to define at least one first support loop extending a first distance from the body support;

a second support loop coupled to the first support loop and to the body support, wherein a first portion of a length of the second support loop is overlappingly coupled along a portion of the binding and the perimeter edge of the body support, and a second portion of a length of the second support loop is overlappingly coupled along a portion of a length of the first support loop extending beyond the body portion, the second support loop extending a second distance from the body support.

2. The person support device of claim 1, wherein the binding is C-shaped and includes an upper surface and a lower surface.

3. The person support device of claim 2, wherein a portion of at least one of the second support loop and the perimeter edge of the body support are positioned between the upper surface and the lower surface.

4. The person support device of claim 1, wherein the first distance is greater than the second distance.

5. The person support device of claim 1, wherein the second distance is greater than the first distance.

6. The person support device of claim 1, wherein the second support loop is coupled to the body support such that the first support loop is positioned between the second support loop and the body support.

7. The person support device of claim 1, wherein the portion of the first loop that the second loop is overlappingly coupled to is connected to the body support.

8. The person support device of claim 1, wherein at least a portion of the body support includes padding.

9. A person support device, comprising:

a body support including an upper body support portion configured to support at least a portion of an occupant's upper body and a lower body support portion configured to support at least a portion of an occupant's lower body;

a binding coupled along a perimeter edge of the body support and extending from at least one of the upper body support portion and the lower body support portion to define at least one first support loop, the first support loop including an upper layer and a lower layer; and a second support loop coupled to the body support and to the at least one first support loop such that a portion of the second support loop is positioned between the upper layer and the lower layer of the first support loop and a portion of the length of the second support loop extends along and is coupled along a portion of the length of the first support loop extending beyond the body support.

10. The person support device of claim 9, wherein the binding is C-shaped.

11. The person support device of claim 9, wherein the second support loop is also coupled to the one of the upper body support portion and the lower body support portion.

12. The person support device of claim 9, wherein the first support loop extends a first distance from the body portion and the second support loop extends a second distance from the body support, the first distance being greater than the second distance.

13. The person support device of claim 9, wherein the second support loop is coupled to the first support loop along a substantial portion of the length of the first support loop.

14. A person support device, comprising:

a body support including an upper body support portion configured to support at least a portion of an occupant's upper body and a plurality of leg support portions extending from the upper body support portion and configured to support an occupant's legs;

a first support loop coupled to the body support and configured to couple with a person lifting device; and a second support loop coupled to the body support at a first coupling point and coupled to the first support loop at a second coupling point spaced away from the body support, the second support loop being configured to couple with a person lifting device, a portion of the length of the second support loop being overlappingly coupled along a portion of a length of the first support loop.

15. The person support device of claim 14, wherein the first support loop is defined by a portion of a binding coupled to a perimeter edge of the body support.

16. The person support device of claim 14, wherein a portion of the length of the second support loop is overlappingly coupled along a portion of a length of the body support.

17. The person support device of claim 14, wherein the first support loop extends a first distance from the body portion and the second support loop extends a second distance from the body support, the first distance being greater than the second distance.

18. The person support device of claim 14, wherein the first support loop includes an upper layer and a lower layer, the second loop is coupled to the first support loop such that a portion of the second support loop is positioned between the upper layer and the lower layer of the first support loop and a portion of the length of the second support loop extends along a portion of the length of the first support loop.

* * * * *